US007137433B2

(12) United States Patent
Dobesberger et al.

(10) Patent No.: US 7,137,433 B2
(45) Date of Patent: Nov. 21, 2006

(54) LIGHTWEIGHT PART, AS WELL AS A PROCESS AND DEVICE FOR ITS PRODUCTION

(75) Inventors: Franz Dobesberger, Schwarzenau (AT); Herbert Flankl, Perg (AT); Dietmar Leitlmeier, Schleissheim/Wels (AT); Alois Birgmann, Moosdorf (AT)

(73) Assignee: Huette Klein-Reichenbach Gesellschaft m.b.H., Schwarzenau (AT)

( * ) Notice: Subject to any disclaimer, the term of this patent is extended or adjusted under 35 U.S.C. 154(b) by 0 days.

(21) Appl. No.: 10/414,096

(22) Filed: Apr. 16, 2003

(65) Prior Publication Data

US 2003/0198827 A1 Oct. 23, 2003

(30) Foreign Application Priority Data

Apr. 19, 2002 (AT) ..... A 610/2002

(51) Int. Cl.
*B22D 19/00* (2006.01)
*C22C 1/08* (2006.01)

(52) U.S. Cl. ..... 164/23; 164/27; 164/94; 164/249; 164/332

(58) Field of Classification Search ..... 164/23, 164/27, 93, 94, 95, 96, 249, 332
See application file for complete search history.

(56) References Cited

U.S. PATENT DOCUMENTS

| | | | | | |
|---|---|---|---|---|---|
| 179,212 | A * | 6/1876 | McDonald | ..... | 164/95 |
| 638,908 | A * | 12/1899 | Cosgrave | ..... | 164/95 |
| 927,062 | A * | 7/1909 | Monnot | ..... | 164/96 |
| 1,011,430 | A * | 12/1911 | Henry | ..... | 164/96 |
| 2,244,367 | A * | 6/1941 | Kinkead | ..... | 164/93 |
| 2,835,008 | A * | 5/1958 | Otani | ..... | 164/93 |
| 3,192,581 | A * | 7/1965 | Sylvester | ..... | 164/66.1 |
| 3,659,323 | A * | 5/1972 | Hachisu et al. | ..... | 29/895.32 |
| 4,713,277 | A | 12/1987 | Akiyama et al. | | |
| 5,281,251 | A | 1/1994 | Kenny et al. | | |
| 5,482,533 | A * | 1/1996 | Masuda et al. | ..... | 75/415 |
| 6,325,462 | B1 * | 12/2001 | Hummel et al. | ..... | 301/65 |
| 6,428,907 | B1 * | 8/2002 | Mehdianpour et al. | ..... | 428/613 |
| 2002/0189779 | A1 | 12/2002 | Knott et al. | | |
| 2003/0141032 | A1 | 7/2003 | Singer et al. | | |

FOREIGN PATENT DOCUMENTS

| | | | |
|---|---|---|---|
| AT | 410104 | * | 6/2002 |
| CA | 2084038 | * | 5/1993 |

(Continued)

*Primary Examiner*—John J. Zimmerman
(74) *Attorney, Agent, or Firm*—Greenblum & Bernstein, P.L.C.

(57) ABSTRACT

A lightweight part and process and device of making the same, the lightweight part including an inner core including a metal foam. A dense core surface layer is metallically joined to the inner core. An outer wall includes an essentially pore-free cast metal layer that is at least one of positively engaged with the dense core surface layer and surrounding the inner core, and metallically joined to the dense core surface layer and surrounding the inner core. The process includes creating a core part by forming the dense core surface layer, forming the inner core of a metal foam, and metallically joining together the inner core and the dense core surface layer. The process further includes creating a finished part by positioning the core part in a casting mold, feeding a melt material into the casting mold, and allowing the melt material to solidify so as to form the outer wall. This abstract is neither intended to define the invention disclosed in this specification nor intended to limit the scope of the invention in any way.

12 Claims, 3 Drawing Sheets

FOREIGN PATENT DOCUMENTS

| | | |
|---|---|---|
| DE | 19501508 | 4/1996 |
| DE | 19650613 | 6/1998 |
| DE | 29723749 | 2/1999 |
| DE | 19908867 | 9/2000 |
| EP | 0210803 | 2/1987 |
| EP | 1134095 | 9/2001 |
| WO | 99/64287 | 12/1999 |
| WO | 01/62416 | 8/2001 |
| WO | 0162415 | 8/2001 |

* cited by examiner x
x'
y
y'
z
21
21'
21''
21'''
211
212
213
213'
214
221
222
231
241
22
23
24
10
2

1
10
12
15
16
17
31
31'
32
32'
32''
33
3
4
x
x'
y

LIGHTWEIGHT PART, AS WELL AS A PROCESS AND DEVICE FOR ITS PRODUCTION

CROSS-REFERENCE TO RELATED APPLICATIONS

The present application claims priority under 35 U.S.C. §119 of Austrian Patent Application No. A 610/2002, filed on Apr. 19, 2002, the disclosure of which is expressly incorporated by reference herein in its entirety.

BACKGROUND OF THE INVENTION

1. Field of the Invention

The invention relates to a lightweight part. The invention also relates to a process and a device for producing the lightweight part.

2. Discussion of Background Information

As a rule, lightweight parts are used, for example, in various supporting or holding functions. They are also used in construction or machine components. They are made to have mechanical and, if necessary, vibration-damping properties, and are also required to simultaneously have low weight. More precisely, such lightweight parts should feature a mass distribution (or material distribution) such that when the part is loaded (or subjected to loading), specific mechanical material stresses whose level is as equal as possible, prevail in all areas. Lightweight parts usually comprise a light metal or a light metal alloy and are advantageously produced by casting. Such parts are also used as so-called crash parts, which exhibit high energy absorption during a deformation.

In principle, lightweight parts are embodied as hollow bodies with thin walls. However, such parts can optionally feature reinforcements in order to counter a slight and/or premature buckling or bulging of the same. These parts may even include reinforcements which are formed by the walls of the part. Such reinforcements can be embodied as curved or waved portions which are arranged transverse to a main load direction. Unfortunately, such complicated internal shapes of cast parts typically require the sand cores used in their production. These must be removed from the cavity after the casting. Such a process is very labor intensive.

To produce simple hollow bodies with, for example, a cylindrical or rectangular cross section cavity shape, reusable metal cores can be used to produce cast lightweight parts. However, there are a number of disadvantages with this method. These relate to limitations relating to shape and thicker wall areas. Moreover, one must also have to accept parts which are heavier than is desired.

SUMMARY OF THE INVENTION

The invention is directed to a lightweight part that has thin supporting outer wall(s), a core that supports the wall(s), and that has reduced weight.

The invention also provides for a process by which a support device that can, if necessary, act as a damping and/or energy-absorption system during a deformation, can be molded inside a supporting wall to produce a lightweight part.

Finally, the invention provides for a device which can be used to produce a lightweight part.

The lightweight part can comprise at least a partly closed metallic outer wall body and an inner area that is formed from a metal foam. The metal foam can be formed by melt metallurgy technology. The inner area may be constructed or formed as a core part that has a dense core surface layer, at least in the area adjacent to the outer wall body. The foamed core inner part can be joined metallically to the layer. An essentially pore-free cast metal layer (having a positive engagement and/or being metallically joined to the core surface layer) may surround the core part as the outer wall body.

The advantages achieved with the invention are essentially to be seen in that the lightweight part is produced from two parts whose surfaces are joined together. In this way, the parts can be formed easily. Moreover, the core part can be formed independently of the outer wall body.

The metal foam of the core part which is produced metallurgically forms a metallic bond with and/or to the core surface layer. This results in a part with high stability and one that is capable of absorbing high supporting forces. For this reason, it is advantageous to form the outer wall body with a low thickness, while ensuring that the part has high loading capacity and low weight.

It is known from WO 01/62416 to produce one-piece molded bodies from metal foam, and in particular from aluminum foam. According to this document, a mold is immersed in a foamable melt and is filled with it, after which foam is introduced into the melt in the mold by rising bubbles. However, the molded body surface, which is formed by the wall areas of the respective foam bubbles adjacent to the mold wall, is thin. Thus, its quality is obviously dependent on the metallostatic pressure. Raising the mold while it is being filled with foam should therefore have a favorable effect on the surface quality of the molded body. However, foam bodies produced in this way have the disadvantages that due to the thin foam bubble wall, and in particular with large individual bubbles, their surface can only be loaded to a limited extent. Also, the molded body wall and the wall surrounding the bubbles are formed of the same materials with the same properties. Thus, it is obviously not favorable to pour these molded bodies into a melt with a different composition. This is because this leads to uncontrollable penetrations and to the collapse of foam bubble walls or in particular of larger bubbles at the surface of the body. As a result, the weight of the part is also affected in an unforeseeable manner.

According to the invention, it is particularly advantageous if the material of the outer wall body and that of the core part have different chemical compositions from one another and/or have a different metallic structure. It is also preferable if they are formed respectively from a light metal or a light metal alloy. It is thus possible to take into account a different stress on the parts. For example the entire core part, with the inner area made of foam, can be formed from a hard and/or brittle particle-containing material. On the other hand, the outer wall body can be composed of soft material or a particle-free matrix material, depending on the desired properties for the lightweight part.

According to one embodiment of the invention, the outer wall body is formed from a tough or tenacious alloy and the core part is formed from a material with ceramic particles in a metal matrix. The lightweight part formed in this way has the ability to absorb or transfer particularly high and also dynamic loads and provides a good damping effect.

The supporting effect of the core surface layer, especially in applications which utilize a small-area loading or edge areas, can be further increased if the gas bubbles of the foamed core inner part feature a largely monomodal size distribution that is in a narrow size range. It is extremely favorable, if the core surface layer has an average thickness of at least approximately 0.30 mm, but not greater than approximately 2.9 mm.

In another embodiment of the invention, that is also cost-effective, the part can be provided with an outer wall body that has contours. These contours can be used to assist in fixing, connecting, attaching and/or guiding the part relative to machines or supporting components. The part may have essentially the same or a constant wall thickness, or may preferably have different wall thicknesses (in whole or in part). The thickness of the outer wall body can also be formed locally with a desired configuration and/or thickness so as to result in essentially equal mechanical stresses in the part when it is loaded.

In this way, the lightweight part can be created to have a particularly low weight. Moreover, the part can be made in a simple manner. Still further the part can form a part of a complicated machine or construction element and this part can be stressed in different ways with good results. The part can also be provided with holes (which can be made in any desired way such as by, e.g., drilling) which may be threaded to receive fixing mechanisms such as bolts and screws.

The invention is also directed to a process of making or producing a lightweight part that includes at least a partly closed metallic outer wall body and an inner area composed of metal foam. In a first stage, a core part with a core surface layer is formed. The core part is a foamed core inner part that is formed by filling it with foam. The core part and the core surface layer are joined and/or attached to each other metallically. This can occur using a mold and the technology of melt metallurgy. In a second stage, the core part is positioned in a casting mold and a melt material is poured around it. This is then allowed to solidify to a certain extent. The outer wall body is thus formed. In this way, a positive engagement and/or a metallic joining of the core surface layer to the outer wall body is created.

The advantages of the process according to the invention are, in particular, that the core part and the outer wall body are manufactured by way of separate process stages. As a result, the part thus formed or the stages can be dimensioned or configured independently of one another. Because the core surface layer is joined metallically to the walls of the peripheral foam bubbles of the core, a particularly lightweight, but also pressure-resistant core body or core part, can be created. The separate manufacture of the core from the outer wall body allows for essentially free contouring of the same far as the dimensions are concerned. Subsequent, the part is finished by pouring material around the core part. In this way, the part can be formed with different wall thicknesses in different parts of the finished part. Accordingly, points where the lightweight part is highly stressed can be made with greater wall thicknesses in order to strengthen portions of the part in a simple manner.

A particularly favorable relationship between the loading capacity and the weight of the lightweight part can be achieved if the core part is formed from a foamable metal or a foamable metallic alloy. The formable material can be selected to have a desired increased strength. The outer wall body can be formed from a metallic material that is different from the core material. The outer wall body material can also preferably be a tough or tenacious light metal alloy.

In the process according to the invention, it be advantageous and important that in the first core-producing process stage, a casting mold is provided with a feed opening. The casting mold should also have at least one small-format opening that is arranged in the vertically highest area of the casting mold. The casting mold should also be brought to and/or left at a temperature that is below the liquidus (i.e., melting) temperature of the foamable alloy. The casting mold can be connected or coupled to a tubular or funnel-shaped pouring or filling piece (which can be heated). One side of the tubular or funnel-shaped pouring or filling piece can be designed to project into the melt material or melt material alloy. Another side of the tubular or funnel-shaped pouring or filling piece can be designed to provide sealing and prevent the escape or leaking of the liquid metal. Air can be expelled or taken out of the casting mold by way of an upwardly directed movement of the meniscus or liquid metal level of the melt through the feed opening and into the highest small-format openings of the casting mold. In this way, a solidified dense core surface layer can be formed against the casting mold. This layer can be formed with the desired thickness against the entire casting mold inner surface. Then, the central liquid metal portion can be displaced by introducing gas bubbles into the melt material. This acts to produce the metal foam within the casting mold. After the foamed core inner part solidifies by way of a targeted removal of heat from the system or arrangement, a composite core part is formed.

By utilizing a pouring or filling device, on which molten metal can be prevented from solidify in a simple manner (e.g., it can for example be heated), melt material is introduced only into the inner chamber of the casting mold and the air is thereby expelled. Because the casting mold according to the invention can be designed to have a temperature that is below the liquidus temperature of the foamable alloy, liquid metal will solidify at the inner wall and in the small-format openings of the mold. In this way, a dense surface layer forms against an inside surface of the casting mold. The layer formation is dependent on the time (i.e., contact time), as well as the temperature of the casting mold and melt material. However, the desired thickness of the core surface layer can easily be controlled or adjusted by regulating these parameters. It should be noted, however, that if the temperature of the casting mold it too high, for example, in the area of the solidus temperature of the alloy, this can lead to the liquid metal emerging from the gaps and air exits and/or to the collapse of the foam bubbles at these points. It can also have a disadvantageous effect on at least the surface quality of the core part, and in particular, on its loading capacity.

After the intended layer formation has been achieved, gas bubbles are introduced into the inner chamber of the casting mold. These gas bubbles develop into or act to create the metal foam. The metallic wall areas of the outer gas bubbles settle on the solidified core surface layer. The metal foam is then solidified by the casting mold through a further removal of heat.

Provision can advantageously be made for complicated core part designs. Moreover, the casting mold can be formed of several parts and have gas-permeable pass gaps. The casting mold can be connected via the feed opening to the pouring or filling piece. In this regard, sealing between the casting mold and the pouring or filling piece can be provided for so that the melt material can rise into the gaps and penetrate any of the small-format openings. The melt material can then solidify within the casting mold so as to form or produce a continuous core surface layer.

In order to increase the stability of the metal foam and/or in order to avoid a collapse of gas bubbles, it is favorable if the gas bubbles displacing or moving within the liquid metal should be essentially equal in size. Depending on the particle content, in particular the SiC content, the distance from the feed opening of the casting mold should be at least approximately 20 mm or more, so that the bubbles are allowed to rise.

Improved properties of the lightweight part can be achieved along with cost-effective manufacture of the same, if the metallic outer wall body is produced in the pressure-casting process. The thickness of the core surface layer of the core part can be produced in the pressure-casting process depending on the foam bubble size of the core inner part, as well as on the liquid metal pressure provided and the planned casting temperature.

The invention also provides for a device for the production of a lightweight part that includes at least a partly closed metallic outer wall body and an inner area composed of metal foam. The part can be made in a device that comprises a core manufacturing device and an outer wall pressure-casting device.

The advantage achieved with this device according to the invention is that it allows for separate usability of the core producing device and the outer wall body producing device. Prerequisites are thus respectively created independently of one another in a simple manner. That is, the core part and the outer wall body can be produced in different stages with certain desired dimensions and/or the wall thicknesses and the contours can be more precisely controlled in certain local areas of the part.

The core manufacturing device, as can be favorably provided, can essentially include a casting mold that has a feed opening at the bottom and that includes at least one outlet opening in the vertically topmost mold area. The device may also optionally include a sealing device for sealing the feed opening of the casting mold. Melt material arranged in a sealable melt vessel can be acted upon by pressure so as to force this material into the casting mold. To facilitate this, the melt vessel has a pouring or filling piece that projects into the melt material. A blowing-in system can also be provided with the metal-foam-forming gas. Using this arrangement, there is the possibility of manufacturing cores with high quality and in a cost-effective manner, even at short intervals.

It is also advantageous, in terms of manufacturing technology, if the casting mold is formed from several parts, if it features gas-permeable pass gaps and if it is connected or coupled to a sealing device. Preferably, the sealing device can be movably mounted, e.g., movable or displaced relative to the mold. Alternatively, the sealing device can be connected or coupled to a pouring or filling piece (which may he heated), so as to seal the melt. The sealing device can also be movably mounted to the melt vessel. Because the casting mold is maintained at a lower temperature, it is desirable for the pass gaps to be gas-permeable at first and subsequently sealed by the melt material, which is solidified therein.

If, as is per se known, a gas inlet system is used which has nozzle parts projecting into the melt material and is arranged at the bottom of the wall of the melt vessel and beneath the pouring or filling piece, the metal foam can be produced with largely the same bubble size. In this way, the supporting effect of the core surface layer can be improved.

In order to control the introduction and speed of the melt material, it is desirable if the melt material, with its meniscus in the inner area of the pouring or filling piece, is introduced into the inner chamber of the casting mold by way of gas pressure that is exerted on the outer meniscus surface in the melt vessel.

It is possible, with particular precision, to maintain the intended or desired wall thickness at all points of the outer wall body if the outer wall pressure-casting device includes a clamping device for holding and positioning the core part. That way, when the clamping device is brought together with other wall mold parts, they form a pressure-casting mold. Then, a nozzle can be attached or positioned on the pressure-casting mold, whereupon a casting metal is fed through the nozzle and into the pressure-casting mold. According to another embodiment, the clamping or positioning device can be embodied as per se known core prints.

Lightweight parts with optionally different outer wall body thicknesses at various positions can be used as parts with a high capacity for deformation energy absorption. These parts can be designed and created such that the start of their deformation is dependent on the pressure and direction of the pressure, as desired.

Because, as previously explained, core parts can be produced with a core surface layer of a desired thickness, it is also possible to make such a part into an object that has a high capacity for deformation energy absorption.

The invention also provides for a lightweight part comprising an inner core comprising a metal foam, a dense core surface layer that is metallically joined to the inner core, and an outer wall comprising an essentially pore-free cast metal layer that is at least one of positively engaged with the dense core surface layer and surrounding the inner core, and metallically joined to the dense core surface layer and surrounding the inner core.

The outer wall and the inner core may have different chemical compositions. The outer wall and the inner core may have a different metallic structure. The outer wall and the inner core may comprise different materials. The outer wall, the inner core and the dense core surface layer may comprise different materials. The outer wall and the inner core may comprise one of a light metal and a light metal alloy. The outer wall may comprise at least one of a tough and a tenacious alloy and the inner core comprises a material that includes ceramic particles and a metal matrix. The inner core may comprise gas bubbles having a largely monomodal size distribution in a narrow size range. The dense core surface layer may comprise an average thickness of between approximately 0.30 mm and approximately 2.9 mm. The outer wall may comprise contours for at least one of fixing and guiding of the lightweight part relative to a machine or a supporting component. The outer wall may comprise an essentially constant wall thickness. The outer wall may comprise portions having different wall thicknesses. The outer wall may comprise portions whose thickness can withstand mechanical stresses.

The invention also provides for a process of making a lightweight part as described above, wherein the method comprises creating a core part by forming the dense core surface layer, forming the inner core of a metal foam, and metallically joining together the inner core and the dense core surface layer and then creating a finished part by positioning the core part in a casting mold, feeding a melt material into the casting mold, and allowing the melt material to solidify so as to form the outer wall.

The inner core can be made of one of a foamable metal and a foamable metallic alloy. The inner core and the outer wall may comprise different metallic materials. The outer wall may comprise at least one of a tough and a tenacious alloy. The outer wall may comprise at least one of a tough and a tenacious alloy and the inner core may comprise a material that includes ceramic particles and a metal matrix. The creating may comprise casting with a first casting mold and the first casting mold may comprise a feed opening and at least one small-format opening arranged at a vertically highest region of the casting mold. The first casting mold may be subjected to a temperature that is below a melt temperature of a material of the inner core. The first casting mold may be maintained at a temperature that is below a melt temperature of a material of the inner core. The first casting mold may be coupled to a filling device that comprises one of a tubular-shaped filling piece and a funnel-shaped filling piece. The filling device may be heated. The filling device may comprise a heating mechanism. The filling device may comprise portions that project into a melt material. The filling device may provide sealing with the first casting mold.

The process may further comprise allowing air to be expelled or taken out of the first casting mold and ensuring that a first melt material is upwardly directed into the first casting mold. The ensuring may comprise allowing one of a meniscus and a liquid metal level of the first melt material to move up through the feed opening, whereby the at least one small-format opening is closed off and whereby the dense core surface layer is solidified and formed with a desired thickness and within an entire casting mold inner surface of the first casting mold.

The process may further comprise introducing bubbles into the first melt material to form the metal foam. The process may further comprise allowing the metal foam to fill a space within the first casting mold. The process may further comprise allowing the metal foam to solidify using targeted removal of heat, whereby the core part is a composite core part.

The first casting mold may comprise several parts which can be connected together and further comprises gas-permeable pass gaps. The bubbles may comprise gas bubbles which are essentially of equal size. The first melt material may comprise a particle content. The particle content may comprise a SiC content. The ensuring may comprise allowing one of a meniscus and a liquid metal level of the first melt material to move up through the feed opening, whereby the at least one small-format opening is closed off, whereby the dense core surface layer is solidified and formed with a desired thickness and within an entire casting mold inner surface of the first casting mold, and whereby a distance between the meniscus or the liquid metal level and the feed opening is at least approximately 20 mm or more.

The creating may comprise a pressure-casting process that controls a thickness of the dense core surface layer based on a foam bubble size, a liquid metal pressure, and a casting temperature.

The invention also provides for a device for production the lightweight according to the process described above, wherein the device comprises a first casting mold that forms the core part and a second casting mold that forms the finished part.

The first casting mold may comprise a feed opening arranged at a bottom end and at least one outlet opening arranged in a vertically topmost area.

The device may further comprise a sealing device that provides sealing between the feed opening and a melt vessel. The device may further comprise a pressure device which can pressurize a first melt material disposed in the melt vessel. The pressure device may comprise a blowing-in system that can introduce a metal-foam-forming gas. The first casting mold may comprise several parts, gas-permeable pass gaps, and a movable sealing device. The pressure device may comprise a gas inlet system that includes nozzle parts projecting into the first melt material. The inlet system may be arranged at a bottom portion of the melt vessel and beneath a pouring or filling piece. A first melt material may be arranged in a melt vessel beneath the first casting mold and the first melt material may comprise a meniscus that is formed in an inner area of a pouring or filling piece, whereby the meniscus is subjected to gas pressure.

The device may further comprise a clamping device for holding and positioning the core part in the second casting mold. The second casting mold may comprise several wall mold parts and a feed inlet that is adapted to receive a feed nozzle.

The invention also provides for a lightweight part comprising an inner core comprising a metal foam, a dense core surface layer comprising a metal material and being attached to and surrounding the inner core, and an outer wall comprising an essentially pore-free cast metal layer that is attached to and surrounding the dense core surface layer.

The invention also provides for a process of making a lightweight part as described above, wherein the process comprises creating a core part using a first casting mold and a melt vessel, the melt vessel containing a first melt material having a meniscus and the first casting mold having a temperature that is less than a temperature of the first melt material, and then forming the dense core surface layer from the meniscus within the first casting mold, forming the inner core of a metal foam within a space defined by the dense core surface layer, whereby the inner core and the dense core surface layer become attached to each other, creating a finished part using a second casting mold and a feeding nozzle by positioning the core part in the second casting mold, feeding a second melt material into the second casting mold, and allowing the melt material to solidify so as to form the outer wall.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
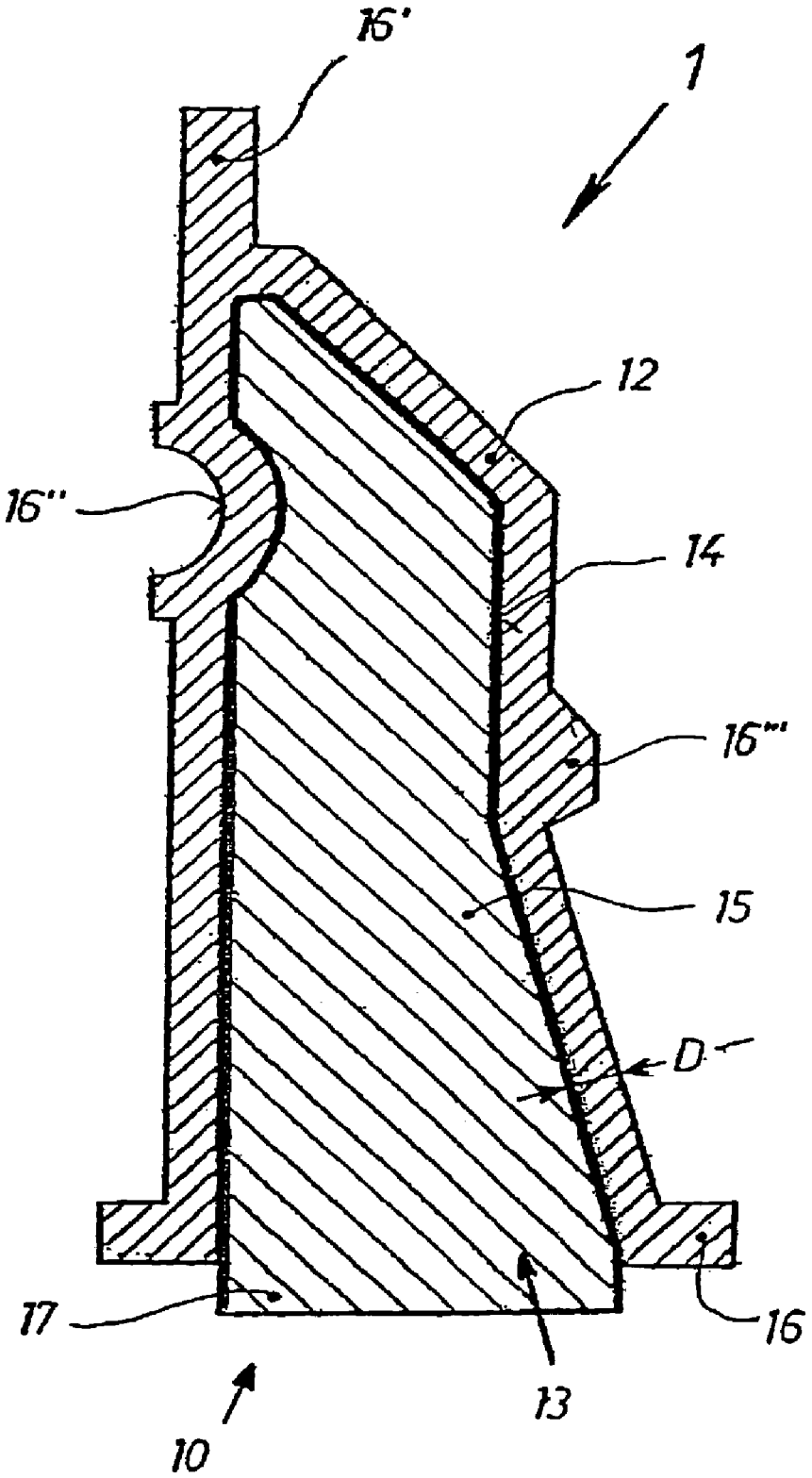
FIG. 1 shows a lightweight part according to the invention.

With reference to FIG. 1, a lightweight part 1 has a core part 10 and an outer wall body 12 that has a thickness D. This thickness D can vary or be constant as desired. A dense closed core surface layer 14 is arranged adjacent the outer wall body 12 and between the core part 10 and the body 12. The core part 10 has an inner area 13 and a core inner part 15 that is formed from metal foam. A clamping area 17 is also provided. The outer wall body 12 can also include contours 16, 16', 16", 16'" that can serve to hold or guide the part relative to other, structures (not shown). Contours 16, 16' and 16'" have the form of projections or projecting portions. On the other hand, contour 16" has the form of a recess or indentation.

FIG. 2 to FIG. 5 illustrate the stages that can be used to manufacture a core part.

Figures 2, 3, 4, 5:
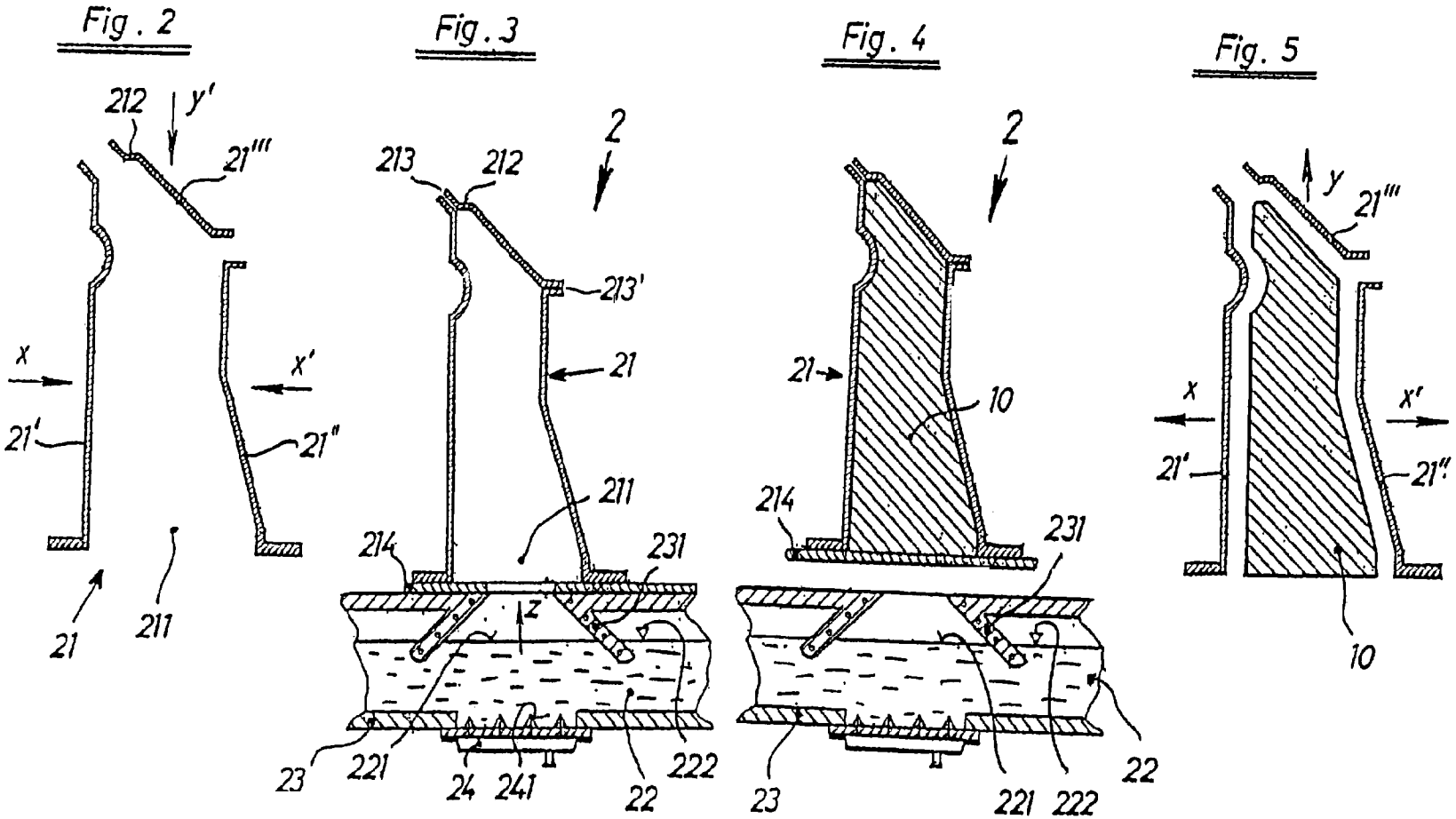
FIG. 2 shows a core part casting mold that can be used to make the light weight part.
FIG. 3 shows the casting mold of FIG. 2 after it is connected to a casting device.
FIG. 4 shows a core part that is formed in the casting mold.
FIG. 5 shows a core part being removed from the casting mold.

FIG. 2 shows one way that a casting mold 21 can be assembled. The mold 21 has a feed opening 211. Casting mold parts 21', 21" can be brought together as side parts along direction X or X' and a casting mold head part 21'", with a gas exit opening 212, can be moved in direction Y'. Once assembled together, the mold parts 21', 21" and 21'" can be braced or assembled together.

FIG. 3 shows a core manufacturing system 2 that uses casting mold 21 and a melt vessel 23 that is connected thereto. The melt vessel 23 has a funnel-shaped filling piece 231. This piece 231 is arranged to project into melt material 22. The piece 231 can also be heated or provided with a heating device. The other side of the filling piece 231 is connected to a sealing device 214 and/or to the mold 21. A gas inlet system 24 that includes a nozzle part 241 is utilized to create the metal foam. This system 24 is arranged and/or inserted in the bottom of the melt vessel 23 and is located vertically below the filling piece 231. However, the invention contemplates that the gas inlet system 24 can be directly positioned in a melt material 22.

In manufacturing the core part 10, a meniscus 221 is formed on the melt material 22 in the interior of the filling piece 231. This meniscus is removed or moved upwards in direction Z through feed opening 211 of a casting mold 21. This can be accomplished, for example, by applying gas pressure on an outer meniscus surface 222 in the closed melt vessel. As the meniscus 221 rises, the air escapes from the casting mold 21 through pass gaps 213, 213' and also through an inserted small-format exit opening 212. The casting mold 21 is maintained or is otherwise made to have a lower temperature than the melt material. In this way, the melt material 22 can solidify in the gaps 213, 213', as well as in the exit opening 212. It also forms a dense core surface layer 14 against the casting mold 21. A subsequent introduction of gas by way of nozzle parts 241 produces stable gas bubbles of essentially the same size in the foamable melt material 22. These bubbles can rise and form a metal foam within the core surface layer 14. Then, as a result of the cooling provided by the casting mold 1, the metal foam solidifies and forms a core part 10. In order to be able to remove the casting mold 21 before the metal foam has completely solidified, a sealing device 214 can be utilized (see FIG. 4) to seal off the feed opening 211.

FIG. 5 shows how the core part 10 can be removed from the casting mold 21.

Figures 6, 7, 8, 9:
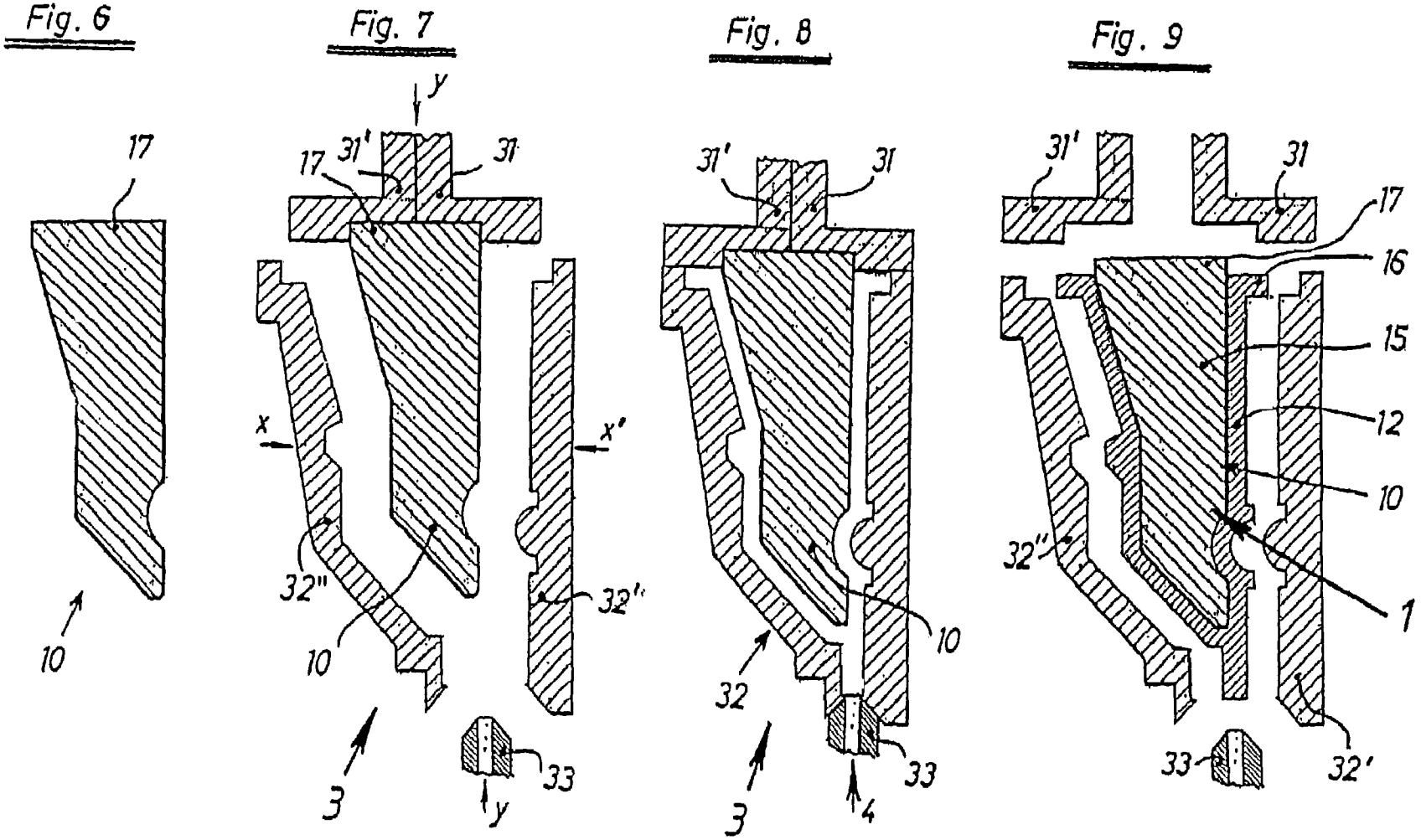
FIG. 6 shows the core part before it is placed in a pressure casting mold.
FIG. 7 shows the core part being held with a holder device before the pressure casting mold is closed around the core part.
FIG. 8 shows the core part within the pressure casting mold. A space is formed between the core part and the pressure casting mold.
FIG. 9 shows the lightweight part when removed from the pressure casting mold.

The core part 10 (shown in FIG. 6) is now ready to be processed further. As shown in FIG. 7 to FIG. 9, it can be provided with an outer wall body 12 using a pressure-casting device 3.

As can be seen from FIG. 7, the core part 10 can be held, for example, by using a core clamping device 31, 31'. Wall mold parts 32', 32" can then be placed or moved adjacent to one another in the direction X, X'. Next, the clamping device is moved along direction Y to produce or assemble the pressure-casting mold 32. Then, for example, a nozzle 33 can be connected thereto, as shown in FIG. 8. As is evident from FIG. 8, a remaining casting gap is provided between the core 10 and the mold 32. This gap is filled with a metal 4 using the nozzle 33 to the material 4 into the mold 32. This is accomplished using a pressure-casting process in such a way that an outer wall body 12 is formed that envelopes the core part 10. In this way, the lightweight part 1 is created.

FIG. 9 shows the contour of a lightweight part 1 and its removal from the mold 32.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of the reference numbers used in the Figures:

| | |
|---|---|
| 1 | Lightweight part |
| 10 | Core part |
| 12 | Outer wall body |
| 13 | Inner area |
| 14 | Core surface layer |
| 15 | Core inner part |
| 16, 16', 16", 16'" | Contours of the outer wall body |
| 17 | Clamping area |
| 2 | Core manufacturing device |
| 21 | Casting mold |
| 21', 21", 21'" | Casting mold parts |
| 211 | Casting mold feed opening |
| 212 | Outlet opening |
| 213, 213' | Pass gaps |
| 214 | Sealing device |
| 22 | Foamable liquid metal |
| 221 | Meniscus |
| 222 | Outer meniscus surface |
| 23 | Melt vessel |
| 231 | Filling piece |
| 24 | Gas inlet device |
| 241 | Nozzle part |
| 3 | Outer wall pressure-casting device |
| 31, 31' | Core clamping device |
| 32 | Pressure-casting mold |
| 32, 32' | Wall mold parts |
| 33 | Nozzle |
| 4 | Pressure-casting metal feed |

What is claimed:

1. A device for producing a lightweight part comprising an inner core comprising a metal foam, a dense core surface layer that is metallically joined to the inner core, and an outer wall comprising an essentially pore-free cast metal layer that is at least one of positively engaged with the dense core surface layer and surrounding the inner core and metallically joined to the dense core surface layer and surrounding the inner core, the device comprising:

a first casting mold that forms the inner core, wherein the inner core is created in the first casting mold by forming the dense core surface layer, forming the inner core of a metal foam, and metallically joining together the inner core and the dense core surface layer;

a second casting mold that forms a finished part, wherein the finished part is created by removing the inner core from the first casting mold, positioning the inner core in the second casting mold, feeding a melt material into the second casting mold, allowing the melt material to solidify so as to form the outer wall, and removing the second casting mold; and a pressure device which can pressurize a first melt material disposed in a melt vessel, wherein the pressure device comprises a gas inlet system that includes nozzle parts projecting into the first melt material, wherein, during forming of the inner core, the gas inlet system is located vertically below a feed opening arranged at a bottom end of the first casting mold, and wherein during forming of the inner core, the first casting mold is connected to a portion of the melt vessel so as to allow the first melt material to pass up through the feed opening.

2. The device of claim 1, wherein the first casting mold comprises at least one outlet opening arranged in a vertically topmost area.

3. The device of claim 2, wherein the device comprises the sealing device and the sealing device provides sealing between the feed opening and the melt vessel.

4. The device of claim 1, wherein the pressure device comprises a blowing-in system can introduce a metal-foam-forming gas.

5. The device of claim 1, wherein the pressure device comprises a system for introducing a metal-foam-forming gas.

6. The device of claim 1, wherein the first casting mold comprises several parts, gas-permeable pass gaps, and a movable sealing device.

7. The device of claim 1, wherein the gas inlet system is arranged at a bottom portion of the melt vessel and beneath a pouring or filling piece.

8. The device of claim 1, wherein the first melt material comprises a meniscus that is formed in an inner area of a pouring or filling piece, whereby the meniscus is subjected to gas pressure.

9. The device of claim 1, further comprising a clamping device for holding and positioning the inner core in the second casting mold.

10. The device of claim 9, wherein the second casting mold comprises several wall mold parts and a feed inlet that is adapted to receive a feed nozzle.

11. A device for producing a lightweight part comprising an inner core comprising a metal foam, a dense core surface layer that is metallically joined to the inner core, and an outer wall comprising an essentially pore-free cast metal layer that is at least one of positively engaged with the dense core surface layer and surrounding the inner core and metallically joined to the dense core surface layer and surrounding the inner core, the device comprising:

a first casting mold that forms the inner core, wherein the inner core is created in the first casting mold by forming the dense core surface layer, forming the inner core of a metal foam, and metallically joining together the inner core and the dense core surface layer;

a second casting mold that forms a finished part, wherein the finished part is created by removing the inner core from the first casting mold, positioning the inner core in the second casting mold, feeding a melt material into the second casting mold, allowing the melt material to solidify so as to form the outer wall, and removing the second casting mold; and a gas inlet system arranged at a bottom portion of a melt vessel and beneath a pouring or filling piece, wherein, during forming of the inner core, the first casting mold is arranged above the pouring or filling piece so as to allow the first melt material to pass up through an opening of the pouring or filling piece and up through a feed opening of the first casting mold.

12. A device for producing a lightweight part comprising an inner core comprising a metal foam, a dense core surface layer that is metallically joined to the inner core, and an outer wall comprising an essentially pore-free cast metal layer that is at least one of positively engaged with the dense core surface layer and surrounding the inner core and metallically joined to the dense core surface layer and surrounding the inner core, the device comprising:

a first casting mold that forms the inner core, wherein the inner core is created in the first casting mold by forming the dense core surface layer, forming the inner core of a metal foam, and metallically joining together the inner core and the dense core surface layer;

a second casting mold that forms a finished part, wherein the finished part is created by removing the inner core from the first casting mold, positioning the inner core in the second casting mold, feeding a melt material into the second casting mold, allowing the melt material to solidify so as to form the outer wall, and removing the second casting mold;

a pressure device arranged within a melt vessel that pressurizes a first melt material;

a sealing device that seals off a feed opening arranged in a bottom end of the first casting mold after the inner core is formed; and a clamping device for holding and positioning the inner core in the second casting mold, wherein, during forming of the inner core, the first casting mold is arranged above an opening in a melt vessel so as to allow a melt material to pass up through the opening of the melt vessel and up through the feed opening.

* * * * *